US006189840B1

(12) United States Patent
Mantovan et al.

(10) Patent No.: US 6,189,840 B1
(45) Date of Patent: Feb. 20, 2001

(54) ROLLER DEVICE FOR DISPLACEMENT OF RAILROAD SWITCHING RAILS

(75) Inventors: Gilson Etore Mantovan, Porto Canoa-Serra-Espírito Santo; Isnad Torres Pires, Jacaraípe-Serra-Espírito Santo; José Roberto Fehlberg, Itaparica-Vila Velha-Espírito Santo; Reynaldo Lopes Ferreira, Jd. da Penha-Vitória-Espírito Santo, all of (BR)

(73) Assignee: Companhia Vale do Rio Doce, Minas Gerais (BR)

( * ) Notice: Under 35 U.S.C. 154(b), the term of this patent shall be extended for 0 days.

(21) Appl. No.: 09/351,345

(22) Filed: Jul. 12, 1999

(30) Foreign Application Priority Data

May 14, 1999 (BR) ..... 7900846 U

(51) Int. Cl.[7] ..... E01B 7/00
(52) U.S. Cl. ..... 246/453
(58) Field of Search ..... 246/415 R, 433, 246/434, 435 R, 442, 453

(56) References Cited

U.S. PATENT DOCUMENTS 5,501,418 * 3/1996 Humphrey et al. ..... 246/453
5,582,371 * 12/1996 Humphrey et al. ..... 246/453
5,622,340 * 4/1997 Turner et al. ..... 246/453
5,628,480 * 5/1997 Vrsecky et al. ..... 246/453

* cited by examiner

*Primary Examiner*—Mark T. Le
(74) *Attorney, Agent, or Firm*—Helfgott & Karas, P.C.

(57) ABSTRACT

A 'ROLLER DEVICE FOR DISPLACEMENT OF RAILROAD SWITCHING RAILS' comprising a basic structure (10), provided in its end with a stylized horizontally-S-shaped laminar locking rib (1), the structure (10) being centrally provided with a pair of trapezium-shaped longitudinal plates (2) parallel to each other. The ends of the shafts (4) of corresponding rollers (5) being attached to cuts (3) of the plates (2). On the opposite end of the basic structure (10), it is defined a L-shaped laminar rib (8), which is mounted on a transversal support (11) defined by a U-shaped folded plate with horizontal extends **(11*a*). The L-shaped end (8) is provided with a pair of through-holes (8*a*), through which goes the through-bolts 8*b*, which are fixed to the transversal support (11), each of the through-bolts (8*b*) going through and being involved by a steel spring (9) with its ends directly contacting the lower face of the L-shaped end (8) and the upper face of the mid-portion of the support (11)**, exerting a separation force between the last components.

1 Claim, 3 Drawing Sheets

ROLLER DEVICE FOR DISPLACEMENT OF RAILROAD SWITCHING RAILS

The present invention relates to a roller device for displacement of switching rails of track shifting apparatuses, commonly used in railroads. As it is well known by those skilled in the art of switching rails displacement, the switch points of the track-ways are provided with track shifting apparatuses, better known as AMV [track shifting apparatuses], which often require cleaning and lubrication services to prevent them from locking.

Such frequent maintenance and cleaning services occurs due to the friction of the switching rails against the slide chair, as well as the contamination which takes place in the ballast, as well as in the slide chair itself.

In practice, there has been currently about eight monthly interventions in the railroad for cleaning and maintenance services on the track shifting apparatuses, causing halts in the regular operation of the apparatus under maintenance service.

Such successive stoppages for maintenance services not only generate a high maintenance cost but also cause environment and ballast contamination.

Accordingly, an object of the present invention is to provide a roller device for displacement of switching rails which reduces from eight to one the monthly maintenance and cleaning interventions in the AMV.

Another object of the present invention is to provide a roller device for displacement of switching rails which does not become worn out by the friction of the switching rail against the slide chair.

Another object of the present invention is to provide a roller device for displacement of switching rails which is not affected by the contamination which takes place in the ballast and also in the slide chair itself.

Another object of the present invention is to provide a roller device for displacement of switching rails which does not require lubrication out of the business hours or working days.

Another object of the present invention is to provide a roller device for displacement of switching rails which eliminates the friction of the switching rails against the slide chair during the operation of the AMV so as to make it unnecessary to lubricate the slide chairs and diminish the stress of the switch machine.

Such and further objects and advantages of this invention are achieved with a roller device for displacement of switching rails, and this will be better understood by referring to the following description taken together with the accompanying drawing, wherein.

Figure 2:
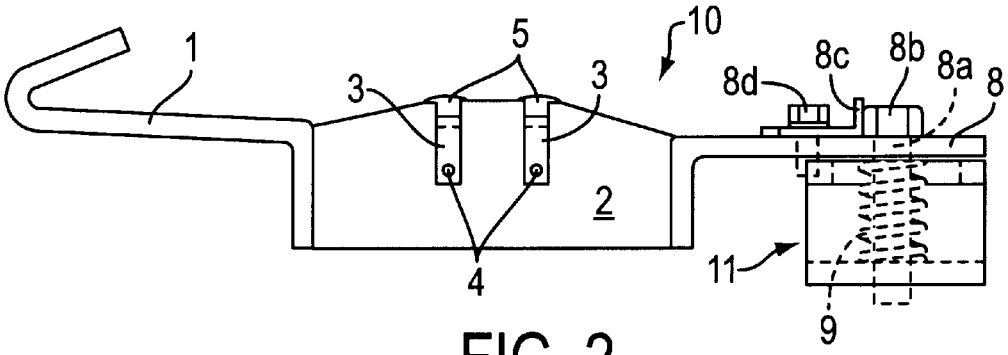
FIG. 2 is a side view of the roller device for displacement of switching rails.
Figure 3:
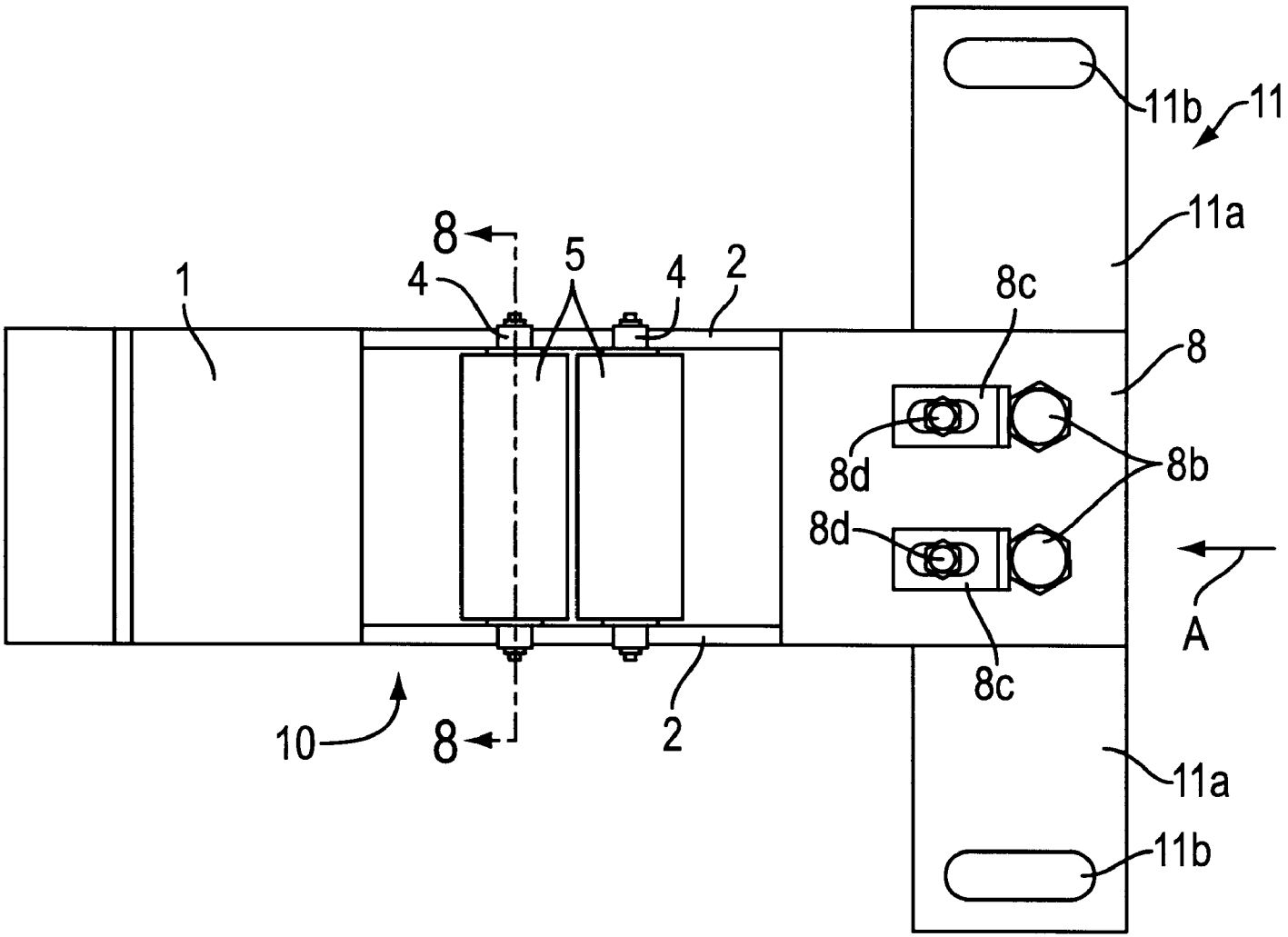
FIG. 3 is an upper view of the roller device for displacement of switching rails.
Figure 5:
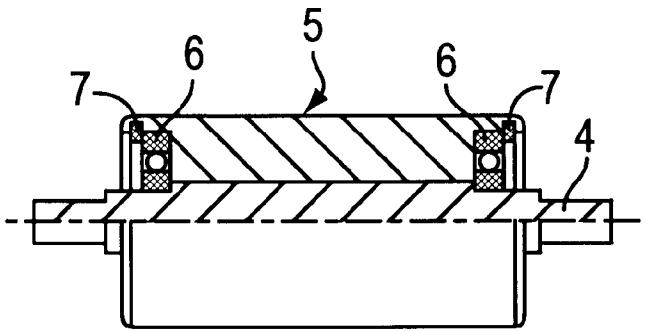
FIG. 5 is a sectional view of the roller which integrates the roller device for displacement of switching rails, taken along line "B—B" of FIG. 4.

According to such illustrations, the roller device for displacement of switching rails in the present invention comprises a basic structure 10, provided in its end with a stylized horizontally-S-shaped laminar locking rib 1, said structure 10 is centrally provided with a pair of trapezium-shaped longitudinal plates 2 parallel to each other, each of said longitudinal plates having in its mid-portion a pair of rectangular cuts 3 extending from the upper edge to half the height thereof, to which are attached the ends of the shafts 4 of corresponding rollers 5, which have inwardly and around the respective shaft 4 a pair of bearings 6 and retainer rings 7, allowing the rotational movement of the rollers 5 around their own axis and relatively to the said longitudinal plates 2 which support them, as shown in FIGS. 2, 3 and 5.

Figure 1:
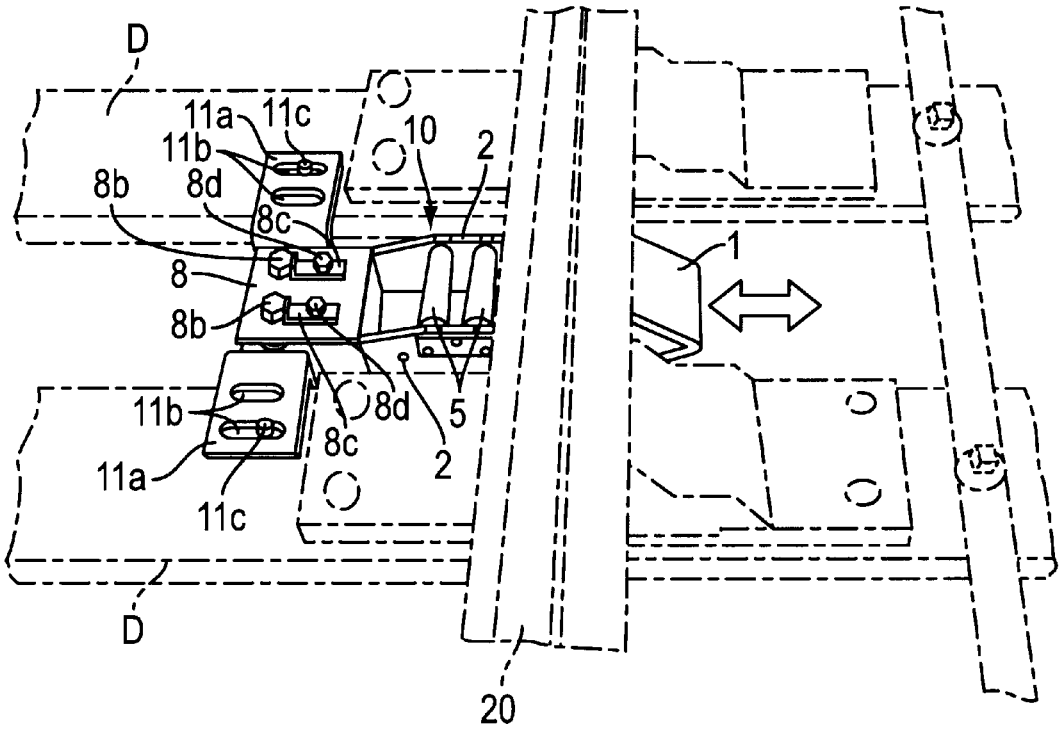
FIG. 1 is a perspective view of a switch point of a railroad provided with the said roller device for displacement of switching rails.

On the opposite end of the basic structure 10, it is defined a L-shaped laminar rib 8, which is mounted on a transversal support 11 defined by a U-shaped folded plate with horizontal extents 11*a*, there being provided oblong holes lib, through which throughbolts 11*c* are passed, from this transversal support 11 in relation to the sleepers D of the railroad track (see FIG. 1).

Figure 4:
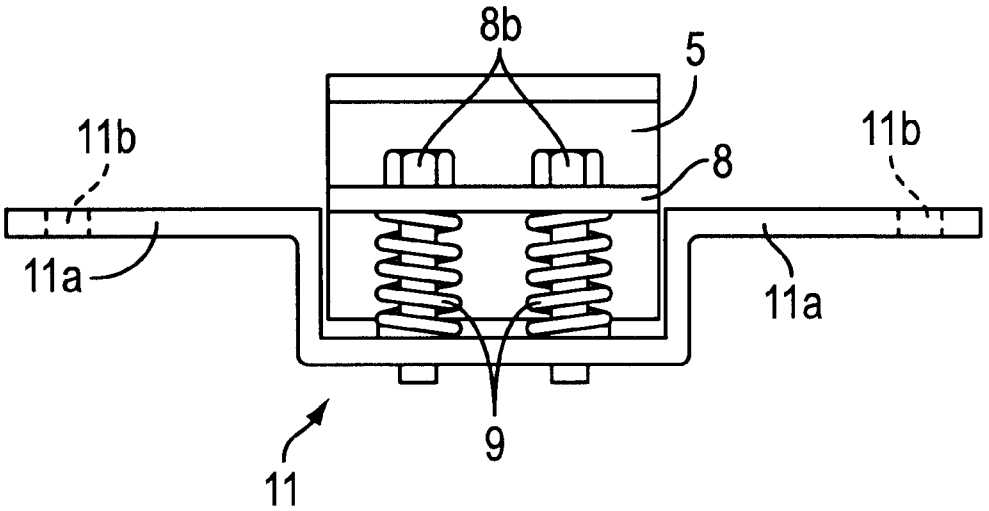
FIG. 4 is a longitudinal view of the roller device for displacement of switching rails, taken along the arrow "A" of the FIG. 3.

The L-shaped end 8 of the basic structure 10 is provided with a pair of through-holes 8*a*, through which through-bolts 8*b* are passed, which are fixed at the lower portion to the transversal support 11, each of the said through-bolts 8*b* going through and being involved by a steel spring 9 with its ends directly contacting the lower face of the L-shaped end 8 and the upper face of the mid-portion of the support 11, exerting a separation force between the last said components, as shown is FIGS. 2 and 4.

The through-bolts 8*b* have hexahedral heads and are prevented from turning relatively to the L-shaped end 8 and support 11 by a small horizontally-L-shaped lock 8*c*, which is secured by bolts 8*d* to the respective through-bolts 8*b* so as to allow the vertical portion of the said locks 8*c* to come in contact with one of the faces of the said through-bolts 8*b*, preventing it from turning, as shown in the figures.

With such an embodiment, the roller device for displacement of switching rails allows the latter to move on the rollers 5 in such a way that, when the switching rail 20 is in the end of its opening course, it is placed on the rollers 5, and when the switching rail 20 is in the end of its closing course, it is about to move upward upon the rollers 5, thus being ready to start an opening displacement.

The springs 9, at the beginning of the movement of the switching rail 20, are compressed in order to allow the said switching rail 20 to have an easy access to the rollers 5 with no need of any additional stress from the switch machine.

The rollers 5 used in the device for displacement of switching rails can be fixed or detachable, and the damping system can comprise springs 9 or rubber.

While the preferred embodiment of the invention has been described and shown above, it will be recognized and understood that various modifications may be made thereto, without departing from the spirit and scope of the invention.

What is claimed is:

1. A roller device for displacement of a railroad switching rail, comprising a basis structure (10) provided at an end with a horizontally S-shaped laminar locking rib (1), said structure (10) being centrally provided with a pair of trapezium-shaped longitudinal plates (2) parallel to each other, each of said longitudinal plates having in its mid-portion a pair of rectangular cuts (3) extending from an upper edge to half a height of the longitudinal plate (2), with ends of shafts (4) of corresponding rollers (5) being attached to said cuts (3) for allowing rotational movements of the rollers (5) around their own axes and relatively to said longitudinal plates (2); wherein, on an opposite end of the basic structure (10), a L-shaped laminar rib (8) is attached, the L-shaped rib (8) is mounted on a transversal support (11) defined by an U-shaped folded plate with horizontal extents (11*a*) which are provided with oblong holes (11*b*), through-bolts (11*c*) pass through said oblong holes (11*b*); and the L-shaped rib (8) is provided with a pair of through-holes (8*a*) that receive further through-bolts (8*b*), the further through-bolts (8*b*) are fixed at a lower portion of the transversal support (11), each of said further through-bolts (8*b*) extends through a steel spring (9) positioned between a lower face of the L-shaped rib (8) and an upper face of the lower portion of the transversal support (11), so as to exert a separation force between said L-shaped rib (8) and said transversal support (11); and a small horizontally L-shaped lock (8*c*) is secured to said L-shaped rib (8) by another bolt (8*d*), said L-shaped lock (8*c*) being positioned against one of said further through-bolts (8*b*) to prevent rotation of the further through-bolt (8*b*).

* * * * *